US005470203A

United States Patent [19]

Mori et al.

[11] Patent Number: 5,470,203

[45] Date of Patent: Nov. 28, 1995

[54] BLOWER BLADE ASSEMBLY HAVING COUNTERBALANCERS

[75] Inventors: Masukazu Mori; Hiroyoshi Yamanaka; Norio Kubota; Naoki Shimokawa, all of Shiga, Japan

[73] Assignee: Matsushita Electric Industrial Co., Ltd., Osaka, Japan

[21] Appl. No.: 220,873

[22] Filed: Mar. 31, 1994

[30] Foreign Application Priority Data

Apr. 2, 1993 [JP] Japan ..... 5-076657

[51] Int. Cl.[6] ..... F04D 29/66

[52] U.S. Cl. ..... 416/144; 416/178

[58] Field of Search ..... 416/144, 145, 416/178, 187; 74/573 R

[56] References Cited

U.S. PATENT DOCUMENTS 3,315,750 4/1967 Delaney ..... 416/144
4,025,231 5/1977 Kochevar et al. ..... 416/144
5,011,374 4/1991 Miller ..... 416/144
5,236,306 8/1993 Hozak ..... 416/144

FOREIGN PATENT DOCUMENTS 3642369 6/1988 Germany ..... 74/573 R

*Primary Examiner*—Edward K. Look
*Assistant Examiner*—James A. Larson
*Attorney, Agent, or Firm*—Wenderoth, Lind & Ponack

[57] ABSTRACT

A blower blade assembly has a plurality of blades, at least one of which is provided with a counterbalancer. The counterbalancer is of one-piece construction and includes a first arm having two contact areas spaced apart from each other and adapted to contact the first surface of the fan blade when the counterbalancer is mounted on the fan blade, a second arm having one contact area adapted to contact the second surface of the fan blade when the counterbalancer is mounted on the fan blade, and an elastic connecting bridge connecting the first and second arms together.

6 Claims, 1 Drawing Sheet

BLOWER BLADE ASSEMBLY HAVING COUNTERBALANCERS

BACKGROUND OF THE INVENTION

1. Field of the Invention

The present invention generally relates to a blower and, more particularly, to a blower blade assembly having a plurality of blades, at least one of which is provided with a counterbalancer.

2. Description of the Prior Art

In air-conditioners, an electrically operated blower is generally utilized and includes a blower blade assembly comprising a plurality of blower blades. It has been well known and is still routine to suppress a wobbling motion of the blade assembly during the rotation thereof about an axis of rotation by equipping at least one of the blower blades with a counterbalancer at a location offset from the axis of rotation of the blower blade assembly.

The counterbalancer generally employed in the art is available in various types. One type is a generally V-shaped rigid element that is mounted on the blower blade with a side edge of the blower blade received in a V-shaped space and is then squeezed by the use of pincers or tongs. Another type is a generally rectangular rigid element that is mounted on a convex surface of the blower blade, having a sectional shape similar to that of a bow, so as to partially embrace the blade and is then fixed in position by the use of a bonding material.

Still, another type is a generally U-shaped clip-like element having a gap smaller than the thickness of the blower blade and mounted on the blower blade in a manner similar to the U-shaped rigid counterbalancer referred to above, but without using the pincers or tongs. This clip-like counterbalancer when mounted on the blower blade contacts two points on respective opposite surfaces of the blower blade.

The use of the V-shaped rigid counterbalancer requires a blower assembly line to execute a squeezing process which incurs a substantial cost. The use of the generally rectangular rigid counterbalancer referred to above has its own problem in that, because of the shape thereof, not only is an accurate positioning of the counterbalancer on the surface of the blower blade difficult, but care is also required to keep the blade assembly still until after the bonding material cures completely.

With respect to the clip-like counterbalancer, the two-point contact system at which the counterbalancer contacts the blower blade at two points is unable to provide a sufficient retaining force with which the counterbalancer can be firmly mounted on the blower blade and, therefore, this clip-like counterbalancer is apt to be displaced on the blower blade during use of the blade assembly.

While the various types of counterbalancers have their own problems discussed above, an additional problem common to all of these types lies in that, since the counterbalancer has been designed and manufactured with no regard paid to the resistance to the flow of air, the blower blade assembly tends to exhibit unfavorable operating characteristics accompanied by generation of noises and a reduction in air capacity.

SUMMARY OF THE INVENTION

The present invention is therefore intended to substantially eliminate the problems inherent in the prior art counterbalancers used on at least one of the blower blades and provides a blower blade assembly having a plurality of blades, at least one of which is provided with an improved counterbalancer. The improved counterbalancer is of one-piece and includes a first arm having two lines of contact spaced apart from each other and along which the first arm contacts the first surface of the fan blade, a second arm having one line of contact along which the second arm contacts the second surface of the fan blade, and an elastic connecting bridge connecting the first and second arms together.

Preferably, the first arm and the second arm each have a free end portion remote from the connecting bridge. The free end portion of the first arm is curved to diverge away from the second arm, whereas the free end portion of the second arm is bent so as to extend away from the first arm.

A free end portion of at least one of the first and second arms remote from the connecting bridge preferably extends in a direction along a surface of the fan blade.

The second arm may have a length in cross section smaller than that of the first arm.

In a more preferred form of the blower blade assembly, the first arm and the second arm, smaller in length in cross section than the first arm, have respective free end portions remote from the connecting bridge, said free end portion of the first arm being curved to diverge away from the second arm whereas said free end portion of the second arm is bent so as to extend away from the first arm.

BRIEF DESCRIPTION OF THE DRAWINGS

These and other objects and features of the present invention will become clear from the following description of a preferred embodiment thereto made with reference to the accompanying drawings, in which like parts are designated by like reference numerals and in which.

DETAILED DESCRIPTION OF THE PREFERRED EMBODIMENT

In describing a preferred embodiment of the present invention, reference is made to a cylindrical cross-flow fan which is an illustrative example of the blower blade assembly.

Figure 1:
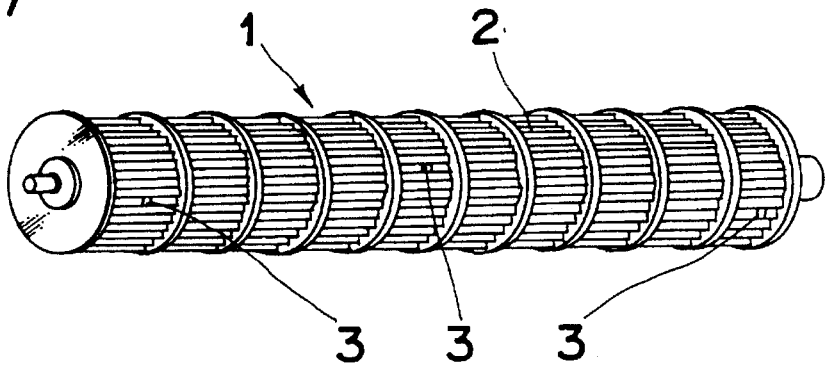
FIG. 1 is a schematic perspective view of a cylindrical cross-flow fan embodying the present invention.

As shown in FIG. 1, the cylindrical cross-flow fan generally identified by reference numeral 1 includes a plurality of elongate blades 2 each having concave and convex surfaces opposite to each other. These blades 2 are arranged in a circular row about an axis of rotation with their opposite ends retained fixedly by corresponding annular end plates while extending parallel to the axis of rotation. Three counterbalancers 3 are shown fixedly mounted on three of the blades 2 at respective locations spaced longitudinally of the cylindrical cross-flow fan 1. The cross-flow fan 1, except for the specific design of each counterbalancer 3, may be of any known structure and, the details thereof will not be described for the sake of brevity.

Figure 2:
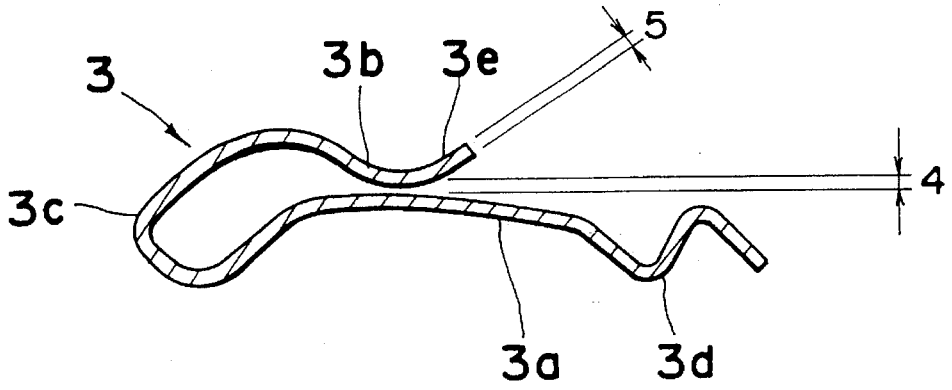
FIG. 2 is a cross-sectional view, on an enlarged scale, of a generally J-shaped clip-like counterbalancer employed in the practice of the present invention.
Figure 3:
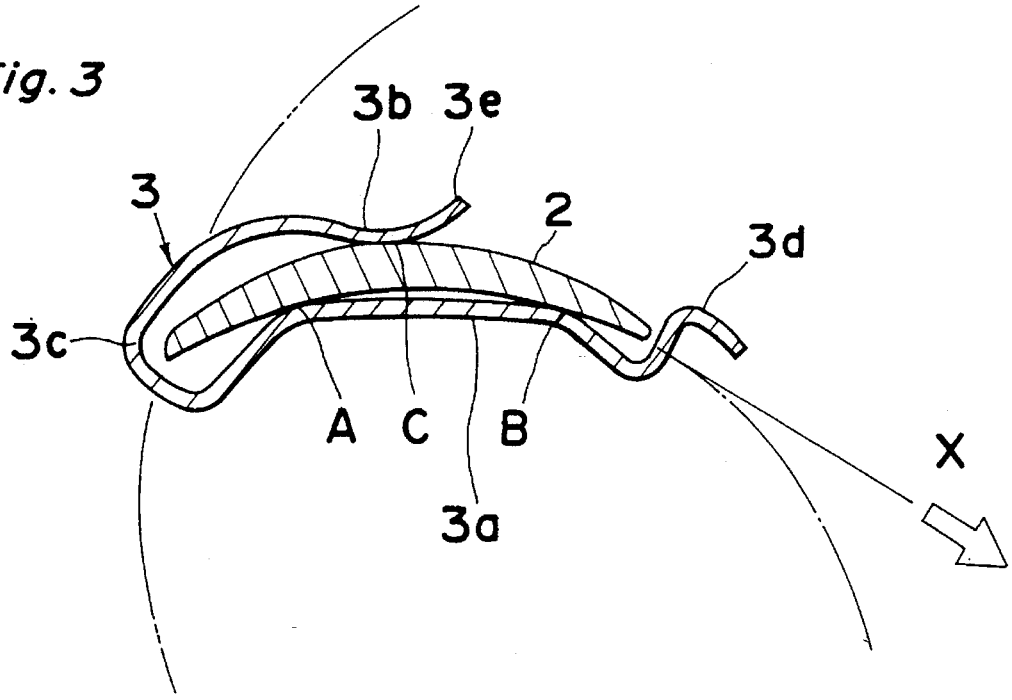
FIG. 3 is a view similar to FIG. 2, showing the counterbalancer mounted on one of the fan blades.

Referring to FIGS. 2 and 3, the counterbalancer 3 employed in the cylindrical cross-flow fan 1 in accordance with the present invention is prepared from a generally rectangular plate member having a weight substantial enough to serve a counterbalancing purpose known to those skilled in the art, which plate member has a generally J-shaped configuration. Thus, the counterbalancer 3 is of one-piece structure including a first arm 3*a*, a second arm 3*b* and a generally U-shaped elastic connecting bridge 3*c* connecting the first and second arms 3*a* and 3*b* together so as to permit the counterbalancer 3 as a whole to possess a generally J-shaped configuration. In a normal condition, one of the first and second arms 3*a* and 3*b* is elastically urged towards the other of the first and second arms 3*a* and 3*b* by the resiliency exhibited by the connecting bridge 3*c*.

As shown in FIG. 3, when the counterbalancer 3 is mounted on the fan blade 2 in a manner which will be described in detail later, the first and second arms 3*a* and 3*b* are disposed below and above the concave and convex surfaces of the fan blade 2, respectively, while the connecting bridge 3*c* is positioned adjacent an outer side edge of the fan blade 2.

The first arm 3*a* is so shaped as to have a generally straight body extending from the connecting bridge 3*c* to a generally S-shaped free end portion 3*d* that first extends in a direction away from an extension of the second arm 3*b*, then extends in a direction towards the extension of the second arm 3*b*, and finally protrudes in a direction away from the connecting bridge 3*c*. On the other hand, the second arm 3*b* is so shaped as to have a free end portion 3*e* warped in a direction away from the generally straight body of the first arm 3*a* while leaving a gap 4 between it and the generally straight body of the first arm 3*a*, which gap is preferably of a size smaller than the thickness 5 of the rectangular plate member used to form the counterbalancer 3.

Thus, it will readily be seen that, since the free end portion 3*e* of the second arm 3*b* is so curved as to diverge away from the generally straight body of the first arm 3*a*, the fan blade 2 can easily be inserted into the gap 4 until the outer side edge of the fan blade 2 approaches the connecting bridge 3*c* as best shown in FIG. 3. Due to this unique configuration of the counterbalancer 3, the mounting of the counterbalancer 3 on the fan blade 2 in the manner described above can advantageously be automated.

Specifically, the counterbalancer 3 employed in the practice of the present invention is so configured that, when the counterbalancer 3 is mounted on the fan blade 2 in the manner described above, opposite ends of the generally straight body of the first arm 3*a* adjacent the connecting bridge 3*c* and the generally S-shaped free end portion 3*d*, respectively, contact the concave surface of the same fan blade 2 along two lines of contact as indicated by A and while the warped free end portion 3*e* of the second arm 3*b* contacts the convex surface of the fan blade 2 along a third line of contact as indicated by C at a location generally intermediate the lines of contact A and B with respect to a direction extending along the fan blade 2 between the leading and trailing edges thereof.

Providing the free end portion 3*d* of the first arm 3*a* with a generally S-shaped configuration is particularly advantageous in minimizing the turbulence of air that departs from the fan blade 2, thereby suppressing the generation of noises which would result from the turbulent flow of air. Preferably, the free end portion 3*d* of the first arm 3*a* remote from the connecting bridge 3*c* forms an angle of ±45 degrees relative to the direction X of extension of the fan blade. This generally S-shaped configuration of the free end portion 3*d* of the first arm 3*a* provides a guide by which the counterbalancer 3 can advantageously be guided during the mounting thereof on the fan blade.

As discussed hereinabove, the gap 4 is of a size smaller than the thickness of the plate member used to make the counterbalancer 3. Therefore, when the counterbalancer 3 is mounted on the fan blade 2, the counterbalancer 3 exerts an increased clamping force effective to permit the counterbalancer 3 to be firmly retained in position on the fan blade 2. In addition, the use of the contact system in which the contact lines A, B and C form the apexes of a triangle makes it difficult for the counterbalancer 3, once mounted on the fan blade 2, to displace or slip off of the fan blade 2.

The fact that the first and second arms 3*a* and 3*b* have different lengths renders it possible to provide a relatively large access area between the respective free ends of the first and second arms 3*a* and 3*b* and, therefore, the fan blade can easily and smoothly be inserted into the gap 4.

Although the present invention has been described in connection with the preferred embodiment thereof with reference to the accompanying drawings, it is to be noted that various changes and modifications will become apparent to those skilled in the art. For example, although in the foregoing embodiment the free end portion 3*d* of the first arm 3*a* has been described as having a shape generally similar to the shape of a figure "S" and the first arm 3*a* has been described as longer than the second arm 3*b*, the present invention is not limited to such features.

Accordingly, such changes and modifications are to be understood as included within the scope of the present invention as defined by the appended claims, unless they otherwise depart therefrom.

What is claimed is:

1. A blower blade assembly which comprises:

a plurality of fan blades arranged in a circular row, each of said fan blades having first and second major surfaces opposite to each other; and a respective one-piece counterbalancer mounted firmly on at least one of the fan blades, said one-piece counterbalancer contacting said major surfaces of said one of the fan blades only along three lines of contact, said counterbalancer including a first arm contacting the first surface of the fan blade along only two of said lines of contact, a second arm contacting the second surface of the fan blade along only a third one of said lines contact, the third line of contact being located intermediate said two lines of contact with respect to a direction extending along said one of the fan blades between leading and trailing edges thereof, and an elastic connecting bridge connecting the first and second arms together, said elastic connecting bridge urging said first and said second arms toward one another in opposite directions, respectively, such that said one of the fan blades is clamped by said first and said second arms by forces exerted thereon by said counterbalancer only at three locations corresponding to said three lines of contact.

2. The blower blade assembly as claimed in claim 1, wherein said first arm has a free end portion remote from the connecting bridge, said free end portion of said first arm being curved to diverge away from the second arm, and wherein said second arm has a free end portion remote from the connecting bridge, said free end portion of said second arm being bent so as to extend away from the first arm.

3. The blower blade assembly as claimed in claim 1, wherein a free end portion of the first arm is positioned to the outside of the trailing edge of the fan blade in a direction of extension of one of the surfaces of the fan blade.

4. The blower blade assembly as claimed in claim 1, wherein said second arm has a length in cross section smaller than that of the first arm.

5. The blower blade assembly as claimed in claim 1, wherein said first arm has a free end portion remote from the connecting bridge, said free end portion of said first arm being curved to diverge away from the second arm, wherein said second arm has a free end portion remote from the connecting bridge, said free end portion of said second arm being bent so as to extend away from the first arm, and wherein said second arm has a length in cross section smaller than that of the first arm.

6. The blower blade assembly as claimed in claim 1, wherein said first arm has a free end portion remote from the connecting bridge, said free end portion of said first arm having an S-shaped configuration.

* * * * *